US008503614B2

(12) United States Patent
Legagneux et al.

(10) Patent No.: US 8,503,614 B2
(45) Date of Patent: Aug. 6, 2013

(54) X-RAYS SOURCE COMPRISING AT LEAST ONE ELECTRON SOURCE COMBINED WITH A PHOTOELECTRIC CONTROL DEVICE

(75) Inventors: Pierre Legagneux, Le Mesnil Saint Denis (FR); Ludovic Hudanski, Giraumont (FR); Pascal Ponard, Neuvecelle (FR); Christophe Bourat, Sciez (FR); Jean-Philippe Schnell, Paris (FR)

(73) Assignee: Thales, Neuily sur Seine (FR)

( * ) Notice: Subject to any disclaimer, the term of this patent is extended or adjusted under 35 U.S.C. 154(b) by 145 days.

(21) Appl. No.: 12/864,316

(22) PCT Filed: Jan. 23, 2009

(86) PCT No.: PCT/EP2009/050809

§ 371 (c)(1),
(2), (4) Date: Jul. 23, 2010

(87) PCT Pub. No.: WO2009/092813

PCT Pub. Date: Jul. 30, 2009

(65) Prior Publication Data

US 2010/0290593 A1 Nov. 18, 2010

(30) Foreign Application Priority Data

Jan. 25, 2008 (FR) ..... 0800397

(51) Int. Cl.
*H01J 35/06* (2006.01)

(52) U.S. Cl.
USPC ..... 378/122; 378/136

(58) Field of Classification Search
USPC ..... 378/122, 136
See application file for complete search history.

(56) References Cited

U.S. PATENT DOCUMENTS

| | | | | |
|---|---|---|---|---|
| 4,606,061 | A * | 8/1986 | Ramamurti | 378/10 |
| 4,627,088 | A * | 12/1986 | Doucet et al. | 378/122 |
| 5,042,058 | A * | 8/1991 | Rentzepis | 378/122 |
| 5,428,658 | A * | 6/1995 | Oettinger et al. | 378/119 |
| 5,602,894 | A * | 2/1997 | Bardash | 378/87 |
| 5,768,337 | A * | 6/1998 | Anderson | 378/136 |
| 6,319,188 | B1 * | 11/2001 | Lovoi | 600/3 |
| 6,324,257 | B1 * | 11/2001 | Halavee | 378/121 |
| 6,333,966 | B1 * | 12/2001 | Schoen | 378/119 |
| 6,333,968 | B1 * | 12/2001 | Whitlock et al. | 378/122 |
| 6,385,292 | B1 * | 5/2002 | Dunham et al. | 378/122 |

(Continued)

FOREIGN PATENT DOCUMENTS

| | | |
|---|---|---|
| FR | 2795864 | 1/2001 |
| FR | 2 879 342 A1 | 6/2006 |

*Primary Examiner* — Allen C. Ho
(74) *Attorney, Agent, or Firm* — Baker & Hostetler, LLP

(57) ABSTRACT

A radiation source includes a vacuum chamber, means for injecting an optical wave, a cold source for emitting electrons, a power supply, an anode for emitting X-rays, and at least one window through which the X-rays exit. A light source delivers the optical wave, and the cold source includes at least one substrate with a conducting surface and is subjected to an electric field. The cold further includes a photoconductive element in which the current is controlled approximately linearly by the illumination and at least one electron-emitting element, the photoconductive element electrically connected in series between an emitting element and a conducting surface. Current photogenerated in the photoconductive device is equal to that emitted by the emitter or the group of emitters with which it is associated, and the emitted stream of X-rays is approximately linearly dependent on the illumination.

32 Claims, 8 Drawing Sheets

U.S. PATENT DOCUMENTS

| | | | | |
|---|---|---|---|---|
| 6,463,124 | B1 * | 10/2002 | Weisman et al. | 378/136 |
| 6,556,651 | B1 * | 4/2003 | Thomson et al. | 378/65 |
| 6,728,335 | B1 * | 4/2004 | Thomson et al. | 378/65 |
| 6,882,703 | B2 * | 4/2005 | Price et al. | 378/91 |
| 6,914,960 | B2 * | 7/2005 | Swanson et al. | 378/119 |
| 7,027,560 | B2 * | 4/2006 | Kindlein | 378/141 |
| 7,085,350 | B2 * | 8/2006 | Dunham et al. | 378/122 |
| 7,085,351 | B2 * | 8/2006 | Lu et al. | 378/122 |
| 7,085,352 | B2 * | 8/2006 | Dunham | 378/122 |
| 7,136,455 | B2 * | 11/2006 | Dunham et al. | 378/119 |
| 7,187,755 | B2 * | 3/2007 | Dunham et al. | 378/119 |
| 7,192,031 | B2 * | 3/2007 | Dunham et al. | 378/122 |
| 7,236,568 | B2 * | 6/2007 | Dinsmore et al. | 378/139 |
| 7,340,029 | B2 * | 3/2008 | Popescu | 378/10 |
| 7,388,944 | B2 * | 6/2008 | Hempel et al. | 378/122 |
| 7,412,033 | B2 * | 8/2008 | Freudenberger et al. | 378/136 |
| 7,496,179 | B2 * | 2/2009 | Freudenberger et al. | 378/122 |
| 7,508,917 | B2 * | 3/2009 | Dittrich et al. | 378/136 |
| 7,526,068 | B2 * | 4/2009 | Dinsmore | 378/137 |
| 7,634,047 | B2 * | 12/2009 | Popescu et al. | 378/19 |
| 7,738,632 | B2 * | 6/2010 | Popescu et al. | 378/136 |
| 7,864,924 | B2 * | 1/2011 | Ziskin et al. | 378/136 |
| 2006/0002514 | A1 | 1/2006 | Dunham | |
| 2009/0261727 | A1 | 10/2009 | Legagneux et al. | |

* cited by examiner

Planar converging beams

Circularly arranged parallel beams

Arrays of perpendicularly arranged parallel beams

Matrix-arranged parallel beams

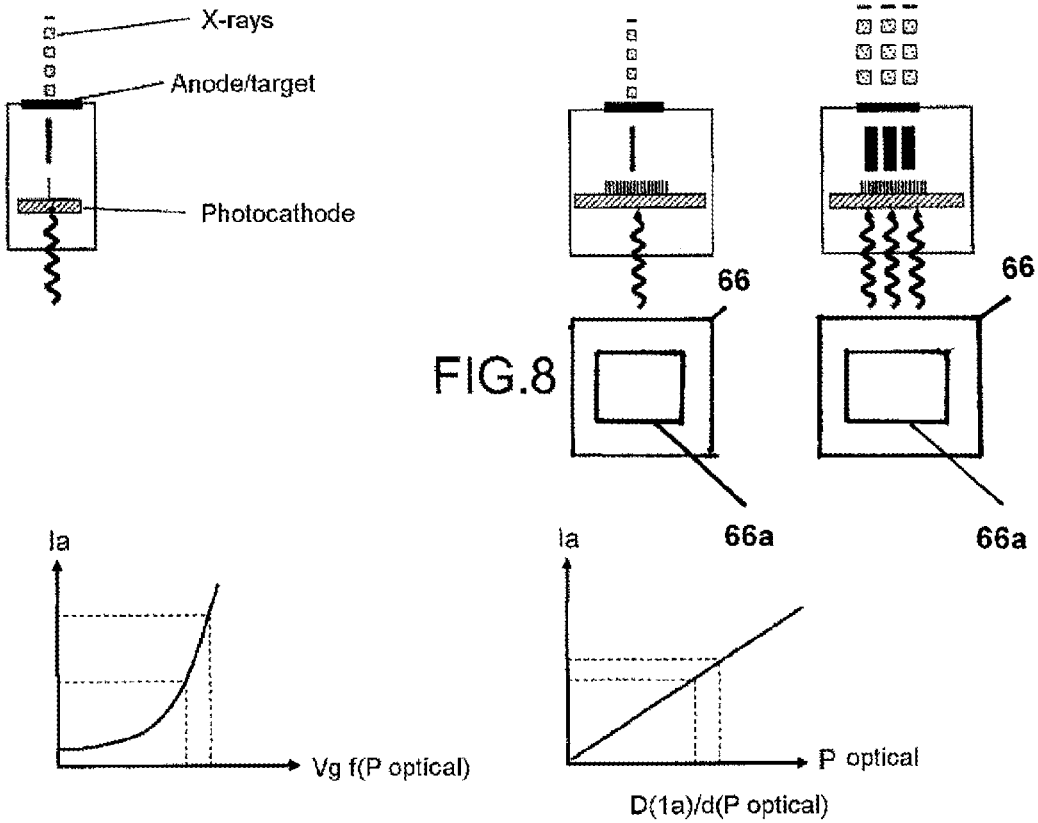
FIG.8
FIG.9a
FIG.9b
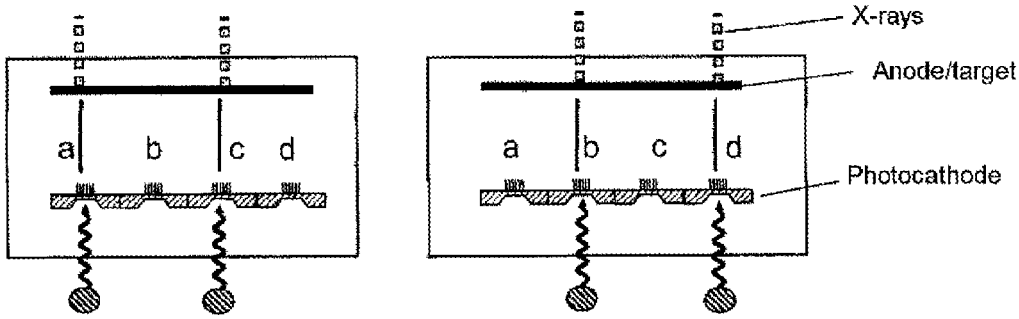
FIG.10a
FIG.10b

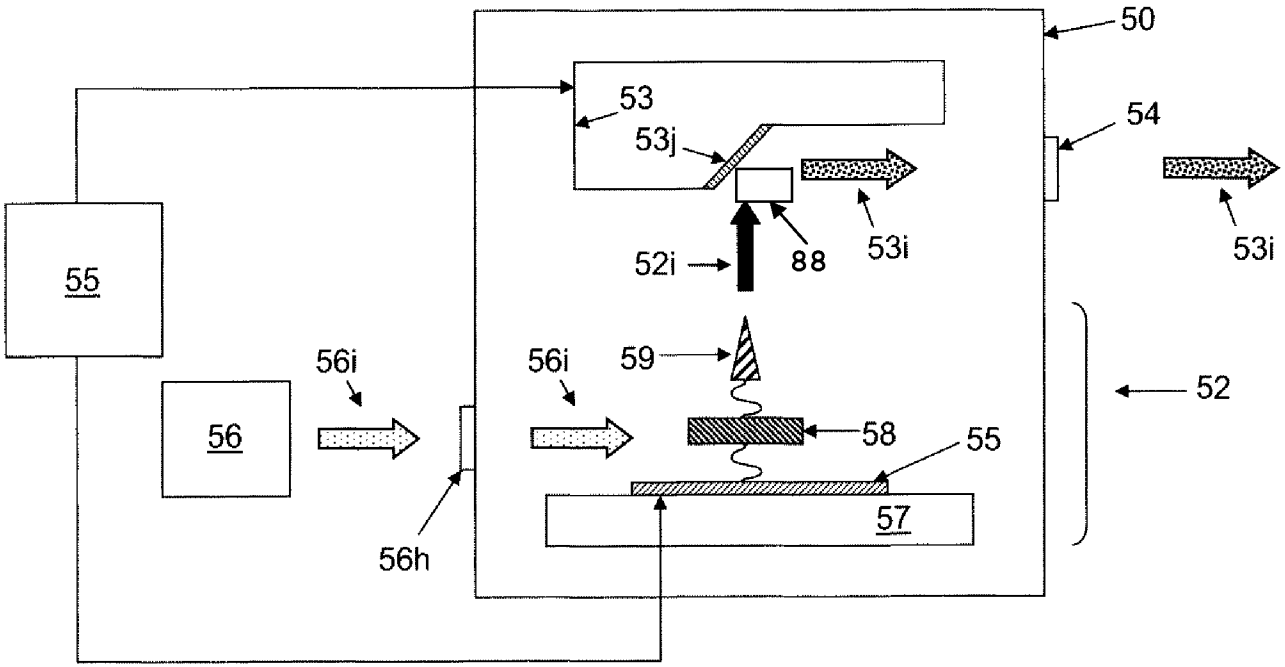
FIG.11-a
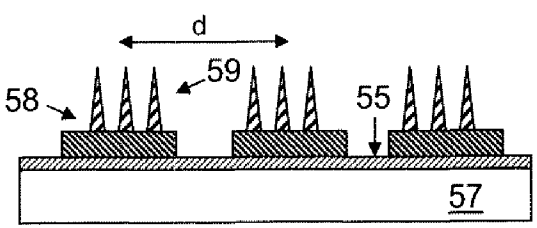
FIG.11-d
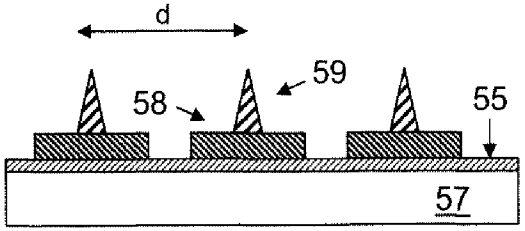
FIG.11-c
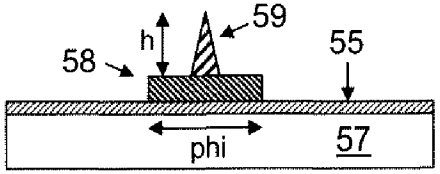
FIG.11-b

X-RAYS SOURCE COMPRISING AT LEAST ONE ELECTRON SOURCE COMBINED WITH A PHOTOELECTRIC CONTROL DEVICE

CROSS-REFERENCE TO RELATED APPLICATIONS

This application is a National Stage of International patent application PCT/EP2009/050809, filed on Jan. 23, 2009, which claims priority to foreign French patent application No. FR 08 00397, filed on Jan. 25, 2008, the disclosures of which are incorporated by reference in their entirety.

FIELD OF THE INVENTION

The field of the invention is that of radiation sources, generally used in industrial, scientific and medical applications so as to deliver a photon flux, notably for producing images using various reconstruction techniques in two or three spatial dimensions. These radiation sources are also useful in the security field, notably for inspecting baggage and parcels by X-rays.

BACKGROUND OF THE INVENTION

For a long time, fixed systems based on transmission X-ray imaging have been used for airport security. Over the last ten years or so, the requirements for security in public places have been growing and require systems on mobile platforms for detecting dangerous chemical substances or explosives concealed in baggage or parcels. The existing mobile systems make use in particular of X-ray backscattering. However, detection and identification capability remains limited. It is difficult in particular to discriminate between substances having similar densities. X-ray transmission is another technique that can be used. It provides access to a combination of the density of the material $\rho$ and its effective atomic number Zeff, but not to each of these two quantities separately, and, in addition, the contributions from several elements constituting the package are superposed, this being dependent on the thickness traversed. 3D transmission imaging using a single energy enables the attenuation coefficient $\mu$ to be mapped at any point on an object. This technique therefore circumvents the traversed thickness problem.

The attenuation coefficient $\mu$ is a function of the density of the material $\rho$ and of its Zeff, and depends on the energy. Multi-energy X-ray transmission in 3D finally enables $\rho$ and Zeff to be determined.

There is a real need for systems providing reliable identification and rapid and easy implementation. These systems require the use of radiation sources that permit three-dimensional imaging without mechanical movement of the source system.

In most cases, the radiation sources use thermionic cathodes as electron emitters, but these solutions have several drawbacks:

In the case of directly-heated thermionic cathodes (FIG. 1A) having a filament Fil facing an anode A, or indirectly-heated thermionic cathodes (FIG. 1B) having a filament Fil heating an impregnated cathode Cath facing an anode A, a first limitation stems from the thermal inertia of such cathodes, preventing rapid modulation of the current and therefore of the X-ray dose rate (for a given energy, the dose rate is often controlled by the current output by the cathode; if the current rise or current fall is not steep, there will be transient X-radiation emission phases that may impair the quality of the received image on the detector). A second limitation stems from the need to have a complex power supply for the filament, if this is a high-voltage supply. The various insulating passages for biasing the grid, filament and cathode are also more complex and bulkier as they have to withstand the high voltages (20 to 600 kV) generally encountered in radiation-generating tubes.

To remedy the abovementioned problem of dynamically controlling the current, devices use a biased grid G, formed for example by wires or a mesh, or a pierced plate as illustrated in FIGS. 2A and 2B.

Thus, each radiation source generally consists of, as a minimum, a cathode, a filament and a current control grid (if the current is modulated), various high voltages being applied to them through a high-voltage insulator as shown in FIG. 2C. The final size of the radiation source is highly dependent on the dimensions of this insulator. Given these electrical connection and insulation constraints, it is very difficult to envisage two (or more) X-ray sources within the same vacuum envelope. Thus, the existing systems comprising several X-ray sources consist of several separate radiation-generating tubes.

In the case of field-emission cold cathodes emitting from tips, notably carbon nanotube tips, in the simplest version the filament and its power supply are omitted, as illustrated in FIG. 3A. However, this diode-type arrangement does not make it possible for the intensity of the emitted current to be controlled independently of the anode voltage. This is because the voltage is fixed by the desired X-ray energy, and the mechanical distance between the anode and the cathode is fixed, so that the electric field at the top of the nanotubes and the emitted current are also fixed. One advantageous arrangement as illustrated in FIG. 3B, consisting optionally of a focusing element F (electrostatic or magnetic focusing) and a biased extraction grid G, may allow the current to be controlled.

Among the main advantages of a cold cathode, notably one based on carbon nanotubes, over a conventional thermionic cathode are notably:

- the elimination of a filament preheating time, resulting in immediate operational availability;
- the absence of fatigue ageing due to the thermomechanical cycles encountered during start/stop sequences,
- the elimination of the filament heated to high temperature and of the associated power supply, resulting in a reduction in the consumed energy and in a simpler power supply; and
- the possibility of modulating the emission by biasing an extraction grid located in front of the carbon nanotube cathode.

For a cold cathode, notably a carbon nanotube cathode, associated with a grid, there are however several limitations due to the presence of the grid in the field of application of radiation-generating tubes.

Among these limitations, the following may be noted:

- the cathode-grid capacitance limits the maximum modulation frequency;
- the current emitted by the cathode varies exponentially with the voltage applied to the grid, degrading the quality with which the current emitted by the cathode is controlled;
- since the grid is not entirely transparent to the electron stream, it intercepts 30 to 50% of the current emitted by the cathode, promoting dimensional variations in this grid caused by it being heated, and consequently generating instability in the current emitted by the cathode because of the exponential variation mentioned above, while thermal inertia and embrittlement are aggravating factors;

the fraction of current intercepted by the grid and the grid heating resulting therefrom are also limitations for using this type of cathode with high currents (a few tens of mA). For example for a cathode of a radiation-generating tube with a voltage of 150 kV for a current of 2 mA, a grid intercepting 40% of the current would have to dissipate 120 W;

in the case of cathodes consisting of a plurality of tips, here nanotubes, a slight inhomogeneity in the geometrical characteristics of the tips results in a large distribution of the fields at the top and therefore in the currents emitted over the set of tips, with values possibly ranging from low emission up to destruction of the nanotube; and it is also necessary to have a complex power supply for controlling the grid voltage relative to the high voltage.

3D imaging devices are of two types. In the first type, the devices comprise an X-ray generator and, facing it, a detector for measuring the radiation that has passed through the object or the patient. To increase the number of viewing angles, these systems require the source and the detector, or the object or the patient to be rotated. These systems are generally unwieldy and complicated, and they require lengthy analysis times incompatible with the latest needs.

The second type permits 3D imaging techniques without any movement of the system or of the object. They require several X-radiation generators and several detectors for observation at various angles of incidence and requiring the images obtained to be recombined in order to extract 3D information therefrom. These "tomosynthesis" systems are simpler than those of the first type and may make it possible for the analysis times and the complexity of the system to be greatly reduced.

Finally, some radiation-generating tubes include, in addition to the high DC voltage, a linear accelerator (or "linac") for bringing the electrons to very high energy so that they produce X-rays that are themselves of very high energy. Electrons are injected into the accelerating structure of a linear accelerator in its conventional configuration by means of an electron gun based on a thermionic cathode, with or without a grid. The electron emission is controlled by the cathode filament heating and/or the control grid bias.

Notably to meet the needs in X-ray medical imaging, the dose flux (Gy/s) must be controlled. Therefore, the emitted dose must be very stable, the dose depending on the uniformity of the electron current generated and on the quality of the device for regulating the photocathode current.

SUMMARY OF THE INVENTION

The present invention proposes, in response, a radiation source comprising a cold electron source subjected to an electric field and operating by field emission, and a photoconductive element placed in series with the electron emitter so that the current photogenerated by illumination in the photoconductive device is equal to that of the emitter.

Thus, the emitted current is controlled by the illumination, either directly or indirectly by controlling the voltage of an extraction electrode. This arrangement ensures that the emission current is linearly dependent on the illumination and that the emitted current is controlled very sensitively and with very high precision.

More specifically, the subject of the invention is a radiation source comprising at least one vacuum chamber, means for injecting an optical wave, at least one cold source capable of emitting electrons in the vacuum by the phenomenon of field emission when it is subjected to a field, at least one power supply delivering a high electrical voltage, at least one anode comprising a material capable of emitting X-rays under the effect of the electron bombardment, and at least one window through which the X-rays exit, at least one light source delivering said optical wave, characterized in that the cold source comprises at least one substrate provided with at least one conducting surface and is subjected to an electric field resulting from the high voltage applied between at least one conducting surface and the anode, said cold source further including at least one photoconductive element in which the current is controlled by the illumination and at least one electron-emitting element, said photoconductive element being electrically connected in series between at least one emitting element and a conducting surface, so that the current photogenerated in the photoconductive device is equal to that of the emitter or the group of emitters with which it is associated and so that the emitted stream of X-rays is approximately linearly dependent on the illumination.

Advantageously, the cold source may operate without an extraction grid.

Advantageously, the cold source may thus be at the high negative voltage and the target anode may be electrically grounded, simplifying the way in which the target anode is cooled.

Advantageously, such a system simplifies the DC decoupling of the current control devices, by DC isolation provided by the optical control.

Advantageously, the control circuits may be low-voltage circuits.

According to one embodiment of the invention, the conducting surface(s), the photoconductor(s) and the emitting element(s) are integrated monolithically on the substrate and thus constitute a photocathode.

According to one embodiment of the invention, the source includes at least one cold electron source with emitting tips.

According to one embodiment of the invention, the source comprises an emitting tip for forming a point-like source for high-resolution X-ray imaging.

This is understood to mean a single emitting tip, the sharp image of which, produced by optics/electronics on the X-ray target, is necessarily smaller (substantially point-like) than that of an array of emitting tips. An image of the object studied with such an X-ray source will necessarily be of higher resolution than an image obtained with an X-ray source associated with an extended array of tips.

According to one embodiment of the invention, the source comprises at least one cold electron source is with an emitting tip made of carbon nanotubes or metal nanowires.

According to one embodiment of the invention, the target material of the electron bombardment is tungsten or a composite comprising tungsten or any other refractory material of high Z.

The term "photoconductive device" is understood to mean one in which the conduction state is controlled by the illumination.

According to one embodiment of the invention, the photoconductive device is of the photodiode type made of a semiconductor with a PIN structure, in which P denotes a P-doped zone, I denotes an intrinsic zone or one not intentionally doped or one that is slightly doped, and N denotes an N-doped zone.

According to one embodiment of the invention, the photoconductive device is an MIN diode in which M denotes a metallic zone.

According to one embodiment of the invention, the photoconductive element comprises a metallic layer on at least one of its contact faces.

According to one embodiment of the invention, the cold source comprises at least one conducting substrate having at least one electron emitter and a photoconductive device so as to form at least one photocathode.

According to one embodiment of the invention, the cold source comprises at least one conducting substrate, at least one tip, the top of which is at a height h relative to the conducting substrate, and at least one photoconductive element placed between the tip and the conducting substrate in such a way that the tip is away from its possible neighbors by a distance d approximately equal to or greater than twice the height h and in such a way that the lateral dimensions phi of the photoconductive elements are approximately equal to or smaller than the height h.

According to one embodiment, the emitters or groups of emitters are placed in regular arrays.

According to one embodiment of the invention, the substrate has a front face supporting the emitting element, the light source illuminating said front face.

According to one embodiment of the invention, the substrate is transparent to said light source, said light source illuminating said substrate on the opposite side from the front face.

According to one embodiment of the invention, the substrate has a thinned zone intended to be illuminated so as to minimize absorption phenomena, said light source illuminating said substrate on the opposite side from the front face.

Advantageously, the radiation source further includes means for regulating the optical power of the light source so as to adjust the power of the X-rays generated.

Advantageously, the source may also include means for adjusting the focusing of the light source on the electron source.

According to one embodiment of the invention, the source comprises a mono-beam X-ray tube of cylindrical symmetry, having a chamber containing a photocathode, a target and a mirror, for illuminating the photocathode with a light beam, perpendicular to the axis of the mono-beam X-ray tube, output by the illumination source, and an optical window for receiving the X-ray emission.

According to one embodiment of the invention, the radiation source comprises several mono-beam X-ray tubes, a circular support supporting said mono-beam X-ray tubes, which are placed radially, a high-voltage power supply, means for distributing the power of said high-voltage power supply over the various mono-beam X-ray tubes, so as to produce X-ray beams, and individual independent optical control means dedicated to each of the mono-beam X-ray tubes.

According to one embodiment of the invention, said optical control beams and the X-ray beams are all mutually parallel and perpendicular to said circular support.

According to another embodiment of the invention, the radiation source further includes means for making said X-ray beams converge.

According to one embodiment of the invention, the radiation source includes a chamber, several assemblies, each consisting of a pair made up of a photocathode associated with a target, and means for distributing the power for said photocathodes.

According to one embodiment, the chamber has a concave shape so as to generate convergent X-ray beams.

According to one embodiment of the invention, the radiation source comprises:

an extended photocathode or a set of photocathodes;

an extended target or a set of targets, facing said extended photocathode or the set of photocathodes respectively; and a device 66*a* for addressing the illumination of an extended photocathode or a set of photocathodes, so as to select various zones over the course of time on the extended photocathode or to select various photocathodes in the set of photocathodes and correspondingly to make the zones of the extended target, or of a target from among the set of targets, emit X-rays.

According to one embodiment of the invention, the addressing device 66*a* is a spatial light modulator 25 and/or 66 illuminated by an extended beam for transferring various illumination laws onto a zone of the extended photocathode or onto a photocathode in the set of photocathodes, and for obtaining the corresponding laws for X-ray emission from a zone of the extended target or of a target of the set of targets.

According to one embodiment of the invention, the source comprises a set of illumination sources and is characterized in that the addressing device 66*a* is an active, optomechanical or optoelectrical, deflector for deflecting the illumination sources associated, in a one-to-one manner, with various zones of the extended photocathode or with various photocathodes of the set of photocathodes, said zones or photocathodes being associated, in a one-to-one manner, with various zones of the extended target or with various targets from among the set of targets.

According to one embodiment of the invention, the source comprises a set of illumination sources and is characterized in that the addressing device 66*a* is an active, optomechanical or optoelectrical, deflector 25 for deflecting the illumination sources associated, in a one-to-one manner, with various zones of the extended photocathode or with various photocathodes of the set of photocathodes, said zones or photocathodes being associated, in a one-to-one manner, with various zones of the extended target or with various targets from among the set of targets.

According to one embodiment of the invention, the light power is distributed, at least partly, by guided propagation (by optical fibers) instead of spatial propagation.

According to one embodiment of the invention, the vacuum chamber includes passages for the optical fibers.

According to one embodiment of the invention, the spatial modulators are of the guided-propagation type.

One or more of the above embodiments may be supplemented and formulated as indicated below:

According to one embodiment of the invention, the radiation source comprises a vacuum chamber and at least one triplet made up, coaxially and consecutively, of:

a photon-transparent window;

a photocathode biased at the high negative voltage; and a target, together with the power supply means for these elements.

According to one embodiment of the invention, the radiation source provides an arrangement of triplets in such a way that they generate spatially convergent X-ray beams.

According to one embodiment of the invention, the radiation source provides an arrangement of the triplets in such a way that they generate parallel X-ray beams organized in a matrix.

According to one embodiment of the invention, the radiation source provides an arrangement of the triplets in such a way that they generate parallel X-ray beams organized in a circle.

According to one embodiment of the invention, the radiation source provides an arrangement of the triplets in such a way that they generate parallel groups of X-ray beams, these groups being mutually perpendicular.

According to one embodiment of the invention, the radiation source further includes at least one linear accelerator for accelerating the electrons emitted by the electron source.

Among the various advantages of the invention, the following may be mentioned:

- the applied illumination serves for individually controlling the current of each emitter, thus avoiding the risks of destroying these emitters due to differences in height of the nanotubes, which risks are encountered when control takes place via an electrode or flat conductor, the voltage of which is varied; and
- no emitter array has to be structurally defined, as in the case of control by an electrode or flat conductor the voltage of which is varied, thus permitting all possible definitions of the emissive zones engaging at least one photocathode.

BRIEF DESCRIPTION OF THE DRAWINGS

The invention will be better understood and other advantages will become apparent from reading the following description given by way of nonlimiting example and thanks to the appended figures in which:

FIG. 8 shows an example of modulation of the electron spot on the target, only associated with the illumination zone (no grid or emitter array for mechanically determining the emission zones);

FIGS. 9A and 9B illustrate the difference in current response of the emitter (exponential response when a control grid is present, linear response when a photocathode according to the invention is present);

FIGS. 10A and 10B illustrate the capability of activating the local emissive zones irradiating an extended target; and FIG. 11A shows a diagram indicating the principle of the invention, while FIGS. 11B, 11C and 11D show details of embodiments of integrated photocathode configurations.

DETAILED DESCRIPTION

In general, the invention proposes installing, in one and the same radiation source, one or more cold cathodes, the emission of which is controlled by a photoconductive device, this type of device typically being of the type as described in French patent application FR 2879342.

Figure 1A:
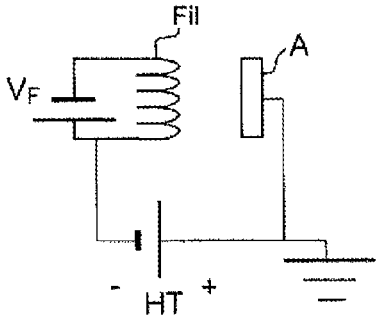
FIG.1A PRIOR ART
FIGS. 1A, 1B illustrate examples of thermionic cathodes of the known art.
Figure 1B:
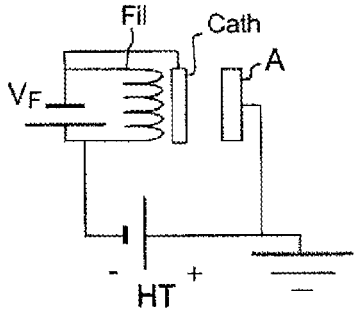
FIG.1B PRIOR ART
Figure 2A:
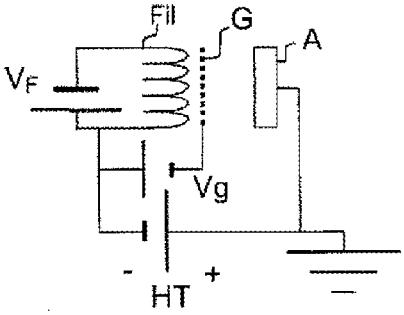
FIG.2A PRIOR ART
FIGS. 2A, 2B, 2C illustrate examples of thermionic cathodes of the known art that further include an intermediate grid.
Figure 2B:
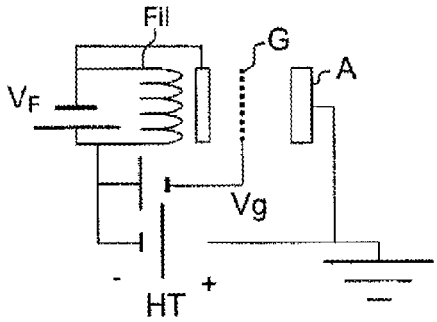
FIG.2B PRIOR ART
Figure 3A:
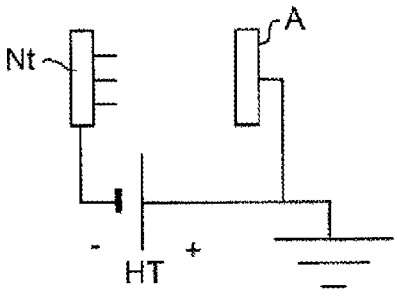
FIG.3A PRIOR ART
FIGS. 3A et 3B illustrate examples of cold cathodes according to the known art.
Figure 3B:
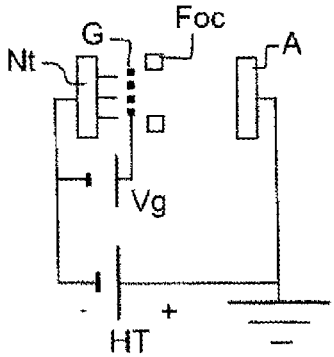
FIG.3B PRIOR ART
Figure 2C:
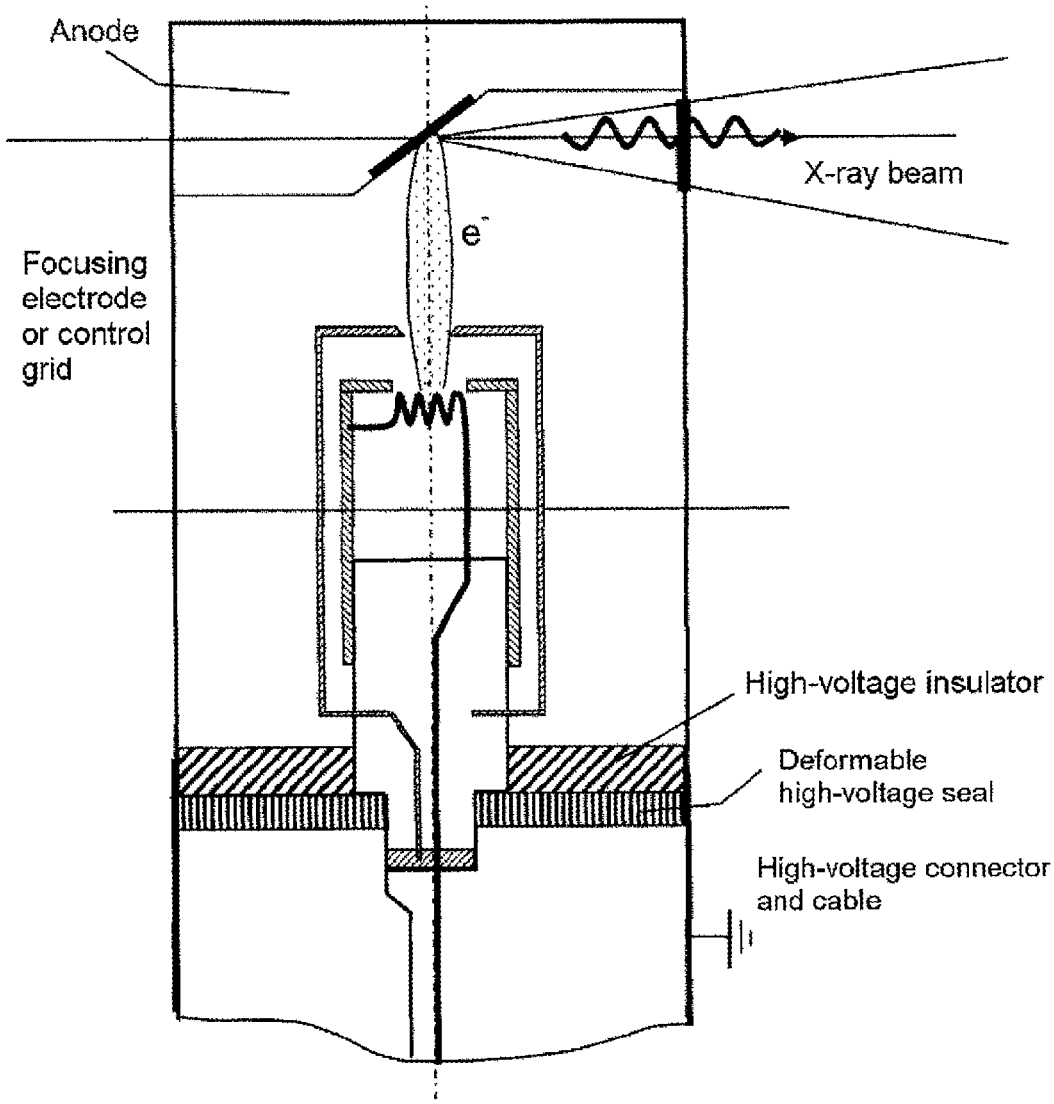
FIG.2C PRIOR ART
Figure 4:
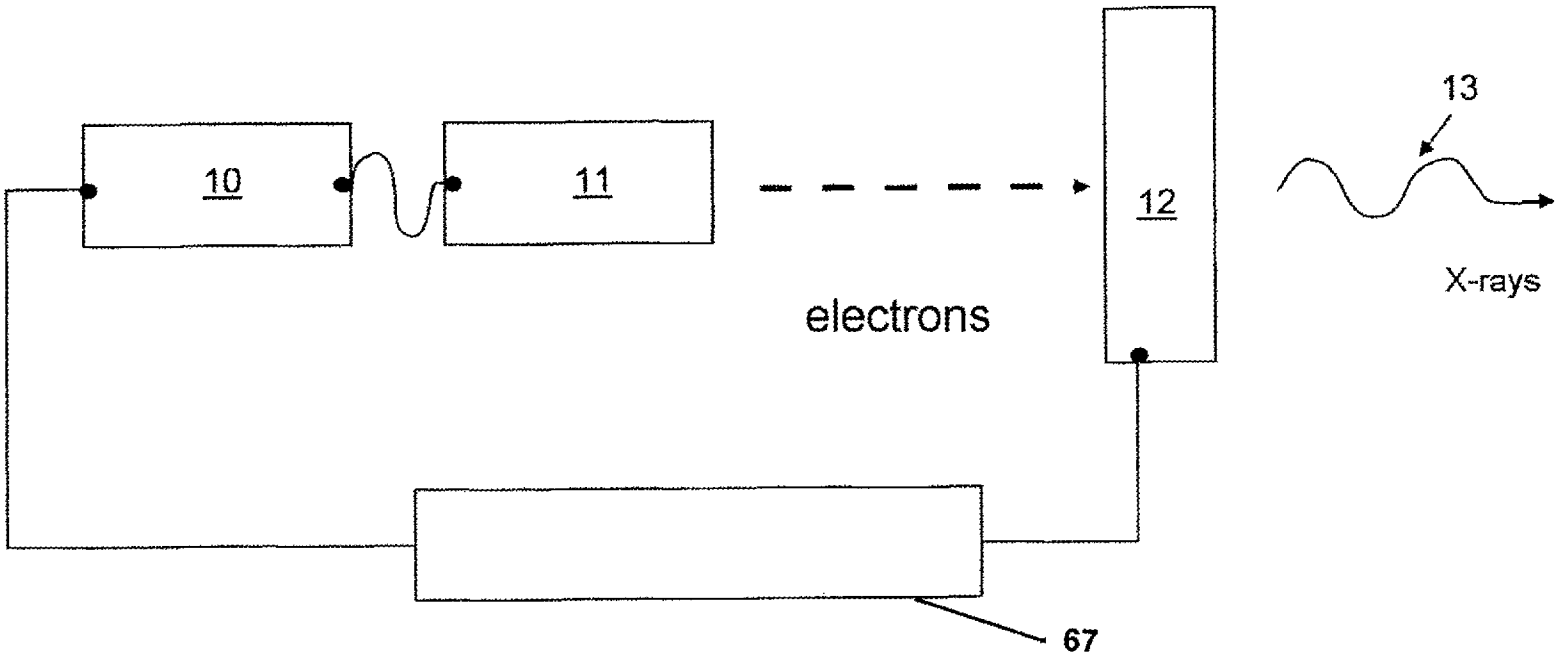
FIG. 4 illustrates a principle of a radiation source according to the invention.

As illustrated schematically in FIG. 4, the radiation source of the invention comprises at least one photoconductive control device 10, an electron source 11 irradiating a target 12 so that the latter emits an X-ray beam 13.

This type of optical decoupling makes it possible to envisage configurations of multiple sources in one and the same vacuum chamber, these being localized or spatially distributed, and producing continuous or temporally modulated X-radiation depending on the illumination of the photocathode.

Exemplary embodiments of radiation sources according to the invention will be described below.

First Exemplary Embodiment

Figure 5:
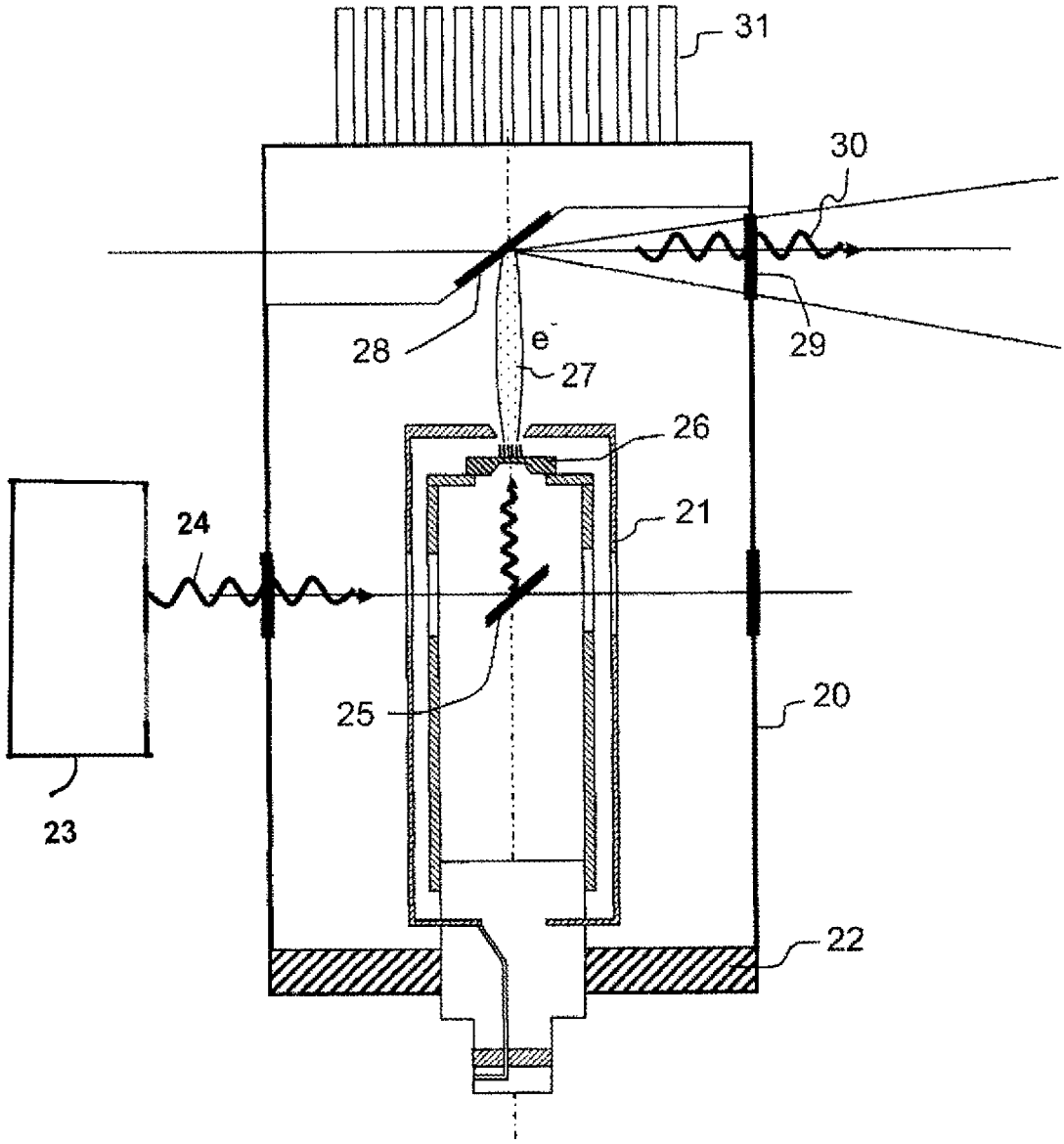
FIG. 5 shows schematically a radiation source according to the invention relative to a mono-beam X-ray tube of cylindrical symmetry.

According to a first embodiment of the invention, illustrated in FIG. 5, the radiation source is a mono-beam source and comprises a vacuum chamber 20, high-voltage power supply means 21 and electrical insulation means 22, an illumination source 23 directing a light beam 24 onto an optically reflective device 25, i.e. reflective for the wavelengths used, so as to excite the photosensitive layers of a cathode 26 for generating an electron stream 27 sent to a target 28. The bombardment of said target then generates the stream of X-rays 30 through a window 29 transparent to said X-rays with which the chamber is equipped. Advantageously, the chamber may also be equipped with means 31 for cooling the target, which is intensely heated during bombardment by the electron streams.

Second Exemplary Embodiment

Figure 6A:
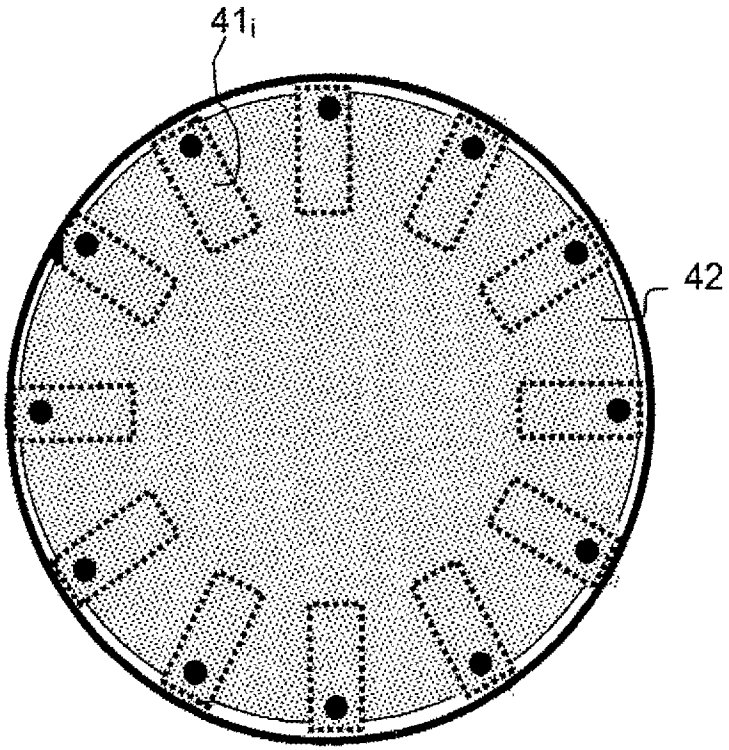
FIGS. 6A and 6B illustrate another example of a radiation source according to the invention relating to several mono-beam X-ray tubes arranged radially.
Figure 6B:
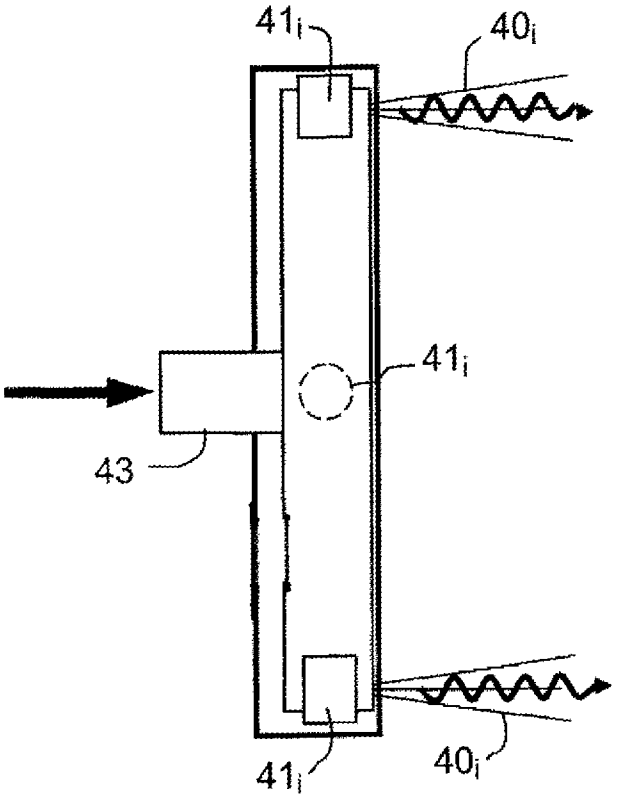

The radiation source generates a multiplicity of X-ray streams 40*i* thanks to the presence of a series of chambers (X-ray tubes) 411 distributed in a circular support 42, said circular support also including means for distributing the power from a high-voltage power supply 43, as illustrated in FIGS. 6A and 6B.

Third Exemplary Embodiment

Figure 7A:
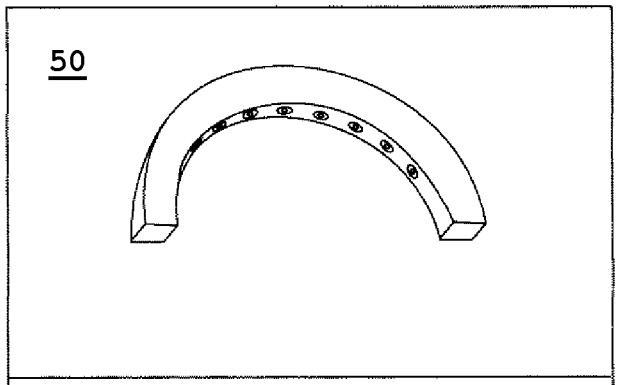
FIGS. 7A, 7B, 7C and 7D illustrate another example of a radiation source according to the invention, relating to a chamber containing several variously disposed sources.
Figure 7B:
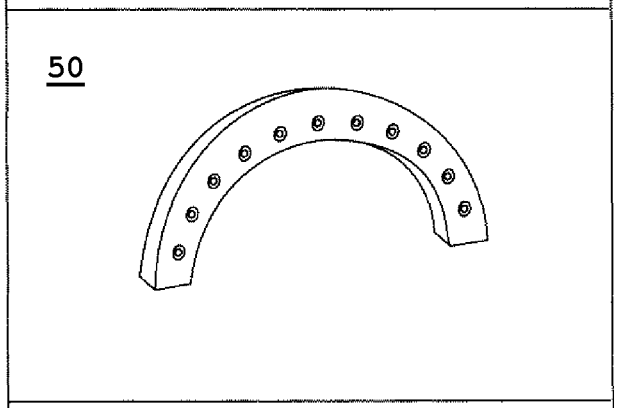
Figure 7C:
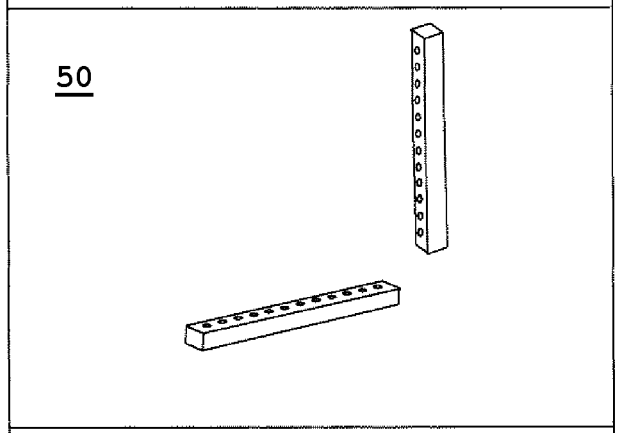
Figure 7D:
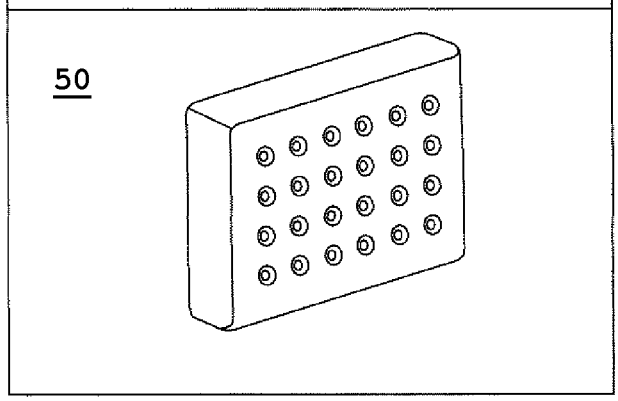

The radiation source may also be a multi-beam source and may comprise a single chamber as illustrated in FIGS. 7A, 7B, 7C and 7D. According to the example shown, said chamber 50 may advantageously be of several forms incorporating variously arranged electron sources. The nonexhaustive examples show: a planar convergent organization (FIG. 7A); a circularly arranged parallel-beam organization (FIG. 7B); a perpendicularly arranged parallel-beam organization (FIG. 7C); and a matrix-arranged parallel-beam organization (FIG. 7D).

FIG. 8 illustrates an example of means for modulating 66 the electron spot on the target, associated only with the illumination zone (with neither a grid nor an emitter array mechanically determining the emission zones).

In general, the present invention provides, in response, a radiation source comprising a cold electron source subjected to an electric field and operating by field emission, and a photoconductive element placed in series with the electron emitter so that the current photogenerated by illumination in the photoconductive device is equal to that of the emitter.

Thus, the emitted current is controlled by the illumination, either directly or indirectly by controlling the voltage of an extraction electrode. This arrangement guarantees that the emission current is linearly dependent on the illumination and ensures that the emitted current is controlled very sensitively and very precisely.

FIGS. 9A and 9B illustrate differences in the current response of the emitter. Thus, the response is exponential when a control gate is present and is linear when a photocathode according to the invention is present.

Fourth Exemplary Embodiment

The examples described above relate to multi-beam radiation sources comprising a set of individual electron sources associated with individual targets.

According to the invention, the multi-beam radiation source may also comprise an extended electron source, having electron emission zones capable of irradiating an extended target in order to generate X-ray beams (as illustrated in FIGS. 10A and 10B). This type of source, associated with scanning means, may typically be used for an imaging configuration such as for example fluoroscopy.

To avoid scattered rays, it may be preferential for rapid scanning to be carried out either using a movable stop or using a scanning device employing electrostatic or magnetic deflectors, as described in patent application 00/08320 by P. De Groot entitled "Générateur de rayons X à balayage pour système d'imagerie susceptible de fonctionner à grande vitesse [Scanning X-ray generator for an imaging system that can operate at high speed]" of 6 Jun. 1999.

Fifth Exemplary Embodiment

The radiation source is a microfocus or nanofocus source that includes optical focusing means, such that a single nanotube is addressed in order to generate an electron beam. The target irradiated by a single nanotube also delivers, as a consequence, an X-ray beam with a very small focal spot. The diameter of the spot of the X-ray microsource or nanosource may be adjusted according to the area of the zone illuminated and thus allow the spot diameter to be controlled as a function of the permissible power density on the target. Optionally, a magnetic or electrostatic focusing system may be used to concentrate all the electrons emitted by the end of the nanotube onto the target in a thermal spot with a size comparable to that of the emissive surface, i.e. a diameter of the order of 10 to 100 nm.

Notably, this type of radiation source may advantageously allow nondestructive testing of, for example, the gate of an integrated-circuit transistor.

Sixth Exemplary Embodiment

The examples described above relate to radiation sources having a high voltage as electron acceleration means. According to the invention, the radiation source may also comprise a "linac" accelerating structure combined with the cold source, a photoelectric device for controlling the electron emission by the cold source, and a light source for controlling said photoelectric device through illumination. In this case, the combination makes it possible to simplify the accelerator, to reduce its volume and to improve the quality of the electron beam and of the X-radiation that it produces.

The specific advantages produced are the following:

initial temporal modulation of the beam at the frequency of the accelerator, with a phase extension enabling a current efficiency close to 100% to be achieved. The entire current, thus emitted in the form of short pulses, allows maximum phase acceptance by the microwave, without longitudinal losses;

reduction in electron losses and therefore thermal losses in the linac;

since the electron packets are already produced at emission, all of the cells of the accelerator are devoted to actually accelerating the beam and not to a preliminary pregrouping phase, allowing the geometry of the linac to be simplified and reducing its length. Thus, the first cavities of the accelerator, conventionally dedicated to temporal beam shaping, may be simplified;

the miniaturization of the electron gun, together with the possibility of controlling the high-frequency current, means that it can be adapted to very-high-frequency linacs (for example operating in the X band);

the short phase extension of the electron packets produced makes it possible to reduce the final energy dispersion of the beam;

with low energy dispersion, the beam exiting the accelerator is easily focused, providing very point-like sources of radiation focused onto the conversion target;

the absence of a system of pregrouping or grouping cavities makes it possible to envisage low-energy (below 4 MeV) linacs with good beam quality;

by controlling the initial current, pulse by pulse, it is possible to envisage variable-current linacs in pulse-to-pulse multi-energy applications in which a constant beam power is necessary for the quality of the X-radiation and of the associated imaging. Such a linac 88 is illustrated in FIG. 11-*a* discussed below.

FIGS. 11A, 11B, 11C and 11D illustrate in detail an example of a radiation source of the invention.

More precisely, this radiation source comprises a vacuum chamber 50, means 56*h* for injecting an optical wave 56*i*, a cold source 52 capable of emitting electrons 52*i* in the vacuum by the phenomenon of field emission when it is subjected to a field, a power supply 55 delivering a high electrical voltage, an anode 53 comprising a material 53*j* capable of emitting X-rays 53*i* under the effect of the electron bombardment, and at least one window 54 through which the X-rays exit, at least one light source 56 delivering said optical wave.

The cold source also comprises at least one substrate 57 provided with at least one conducting surface 55 and is subjected to an electric field resulting from the high voltage applied between at least one conducting surface 55 and the anode 53, said cold source further including at least one photoconductive element 58 in which the current is controlled approximately linearly by the illumination and at least one electron-emitting element 59, said photoconductive element 58 being electrically connected in series between at least one emitting element 59 and a conducting surface 55, so that the current photogenerated in the photoconductive device is equal to that emitted by the emitter or the group of emitters with which it is associated and so that the emitted stream of X-rays is approximately linearly dependent on the illumination.

The invention claimed is:

1. A radiation source comprising:

a vacuum chamber;

means for injecting an optical wave;

a cold source capable of emitting electrons in the vacuum chamber by a phenomenon of field emission when it is subjected to a field;

a power supply for delivering a high electrical voltage;

an anode including a material capable of emitting X-rays under an effect of electron bombardment;

at least one window through which the X-rays exit; and at least one light source delivering said optical wave, wherein the cold source comprises at least one substrate provided with at least one conducting surface and is subjected to an electric field resulting from the high electrical voltage applied between the at least one conducting surface and the anode, said cold source further including at least one photoconductive element in which a current is controlled approximately linearly by an illumination and at least one electron-emitting element, said the at least one photoconductive element being electrically connected in series between the at least one electron-emitting element and the at least one conducting surface, so that a current photogenerated in the at least one photoconductive element is equal to that emitted by the at least one electron emitting element with which it is associated and so that an emitted stream of X-rays is approximately linearly dependent on the illumination.

2. The radiation source as claimed in claim 1, wherein the anode supporting a target is electrically grounded and the cold source is at a high negative voltage.

3. The radiation source as claimed in claim 2, wherein the target is made from a material comprising tungsten or any other refractory material of high Z.

4. The radiation source as claimed in claim 2, wherein the target and the at least one window through which the X-rays exit are coincident.

5. The radiation source as claimed in claim 1, wherein the at least one conducting surface, the at least one photoconductor and the at least one electron emitting element are integrated monolithically on the at least one substrate.

6. The radiation source as claimed in claim 1, wherein the cold source has emitting tips.

7. The radiation source as claimed in claim 6, wherein the emitting tips are a single emitting tip for forming a point-like X-ray source for high-resolution X-ray imaging.

8. The radiation source as claimed in claim 6, wherein the at least one electron emitting element are placed in regular arrays.

9. The radiation source as claimed in claim 1, wherein the cold source comprises the at least one electron-emitting element having at least one tip, the top of which is at a height h relative to the at least one substrate provided with the at least one conducting surface, and the at least one photoconductive element placed between the at least one tip and the at least one substrate provided with the at least one conducting surface in such a way that the at least one tip is away from its possible neighbors by a distance d approximately equal to or greater than twice the height h and in such a way that a lateral dimension phi of the at least one photoconductive element is approximately equal to or smaller than the height h.

10. The radiation source as claimed in claim 1, wherein the cold source has an emitting tip made of carbon nanotubes or metal nanowires.

11. The radiation source as claimed in claim 1, wherein the at least one photoconductive element is of a photodiode type made of a semiconductor with a PIN structure in which I denotes an intrinsic zone or one which is not intentionally doped or one which is lightly doped, the doping being of the N- or P-type.

12. The radiation source as claimed in claim 1, wherein the at least one photoconductive element is an MIN diode in which M denotes a metallic zone.

13. The radiation source as claimed in claim 1, wherein the at least one photoconductive element comprises a metallic layer on at least one of its contact faces.

14. The radiation source as claimed in claim 13, wherein the at least one substrate has a thinned zone intended to be illuminated so as to minimize absorption phenomena in the at least one substrate, said at least one light source illuminating said at least one substrate on an opposite side from a front face.

15. The radiation source as claimed in claim 1, wherein the at least one substrate has a front face supporting the at least one electron-emitting element, the at least one light source illuminating said front face.

16. The radiation source as claimed in claim 1, wherein the at least one substrate is transparent to said optical wave, said optical wave illuminating said at least one substrate on an opposite side from a front face.

17. The radiation source as claimed in claim 1, further comprising means for regulating optical power of the at least one light source so as to adjust a power of the X-rays generated.

18. The radiation source as claimed in claim 1, further comprising means for adjusting focusing of the at least one light source on the cold source.

19. The radiation source as claimed in claim 1, further comprising a mono-beam X-ray tube of cylindrical symmetry, having the vacuum chamber containing a photocathode, a target and a mirror, for illuminating the photocathode, the photocathode comprises of the at least one substrate provided with the at least one conducting surface having at least one electron-emitting element and the at least one photoconductive element with the optical wave entering the mono-beam X-ray tube via its cylindrical wall.

20. The radiation source as claimed in claim 1, further comprising a plurality of mono-beam X-ray tubes, a circular support supporting said plurality of mono-beam X-ray tubes, which are placed radially, the power supply, means for distributing the power of said power supply over the plurality of mono-beam X-ray tubes, so as to produce X-ray beams, and individual independent optical control means dedicated to each of the plurality of mono-beam X-ray tubes.

21. The radiation source as claimed in claim 20, wherein said optical control means and X-ray beams are all mutually parallel and perpendicular to said circular support.

22. The radiation source as claimed in claim 20, further including means for making said X-ray beams converge.

23. The radiation source as claimed in claim 1, further comprising the vacuum chamber, several assemblies, each of the several assemblies consisting of a pair of a photocathodes associated with a target supported by the anode and means for distributing power for said photocathodes.

24. The radiation source as claimed in claim 23, wherein the vacuum chamber has a concave shape so as to generate convergent X-ray beams.

25. The radiation source as claimed in claim 1, wherein the cold source further comprises:

an extended photocathode or a set of photocathodes;

the anode comprises:

an extended target or a set of targets, facing said extended photocathode or the set of photocathodes respectively; and a device for addressing an illumination of the extended photocathode or the set of photocathodes, so as to select various zones over a course of time on the extended photocathode or to select various photocathodes in the set of photocathodes and correspondingly to make the zones of the extended target, or of a target from among the set of targets, emit X-rays.

26. The radiation source as claimed in claim 25, wherein the device for addressing is a spatial and/or temporal modulator configured to deflect the optical wave coming from the at least one light source onto various zones of the extended photocathode or various photocathodes among the set of photocathodes.

27. The radiation source as claimed in claim 25, wherein the device for addressing is a spatial light modulator illuminated by the optical wave for transferring illumination patterns onto a zone of the extended photocathode or onto a photocathode in the set of photocathodes, and for obtaining the corresponding patterns for X-ray emission from a zone of the extended target or of a target of the set of targets.

28. The radiation source as claimed in claim 25, wherein the at least one light source comprises a set of illumination sources, wherein the addressing device is an active, optomechanical or optoelectrical, deflector for deflecting the optical wave associated, in a one-to-one manner, with various zones of the extended photocathode or with various photocathodes of the set of photocathodes, said zones or photocathodes being associated, in a one-to-one manner, with various zones of the extended target or with various targets from among the set of targets.

29. The radiation source as claimed in claim 1, further comprising at least one linear accelerator for accelerating the electrons emitted by the cold source.

30. The radiation source as claimed in claim 1 further comprising:

optical fibers through which the optical wave is distributed, at least partly, by guided propagation instead of spatial propagation.

31. The radiation source as claimed in claim 1 further comprising:

spatial modulators that are of a guided-propagation type configured to deflect the optical wave.

32. The radiation source as claimed in claim 1, wherein the vacuum chamber includes passages for optical fibers.

* * * * *